United States Patent [19]

Purcell

[11] 4,014,143

[45] Mar. 29, 1977

[54] BUILDING STRUCTURAL SYSTEM

[76] Inventor: Kenneth G. Purcell, 807 S. Catalina Ave., Redondo Beach, Calif. 90277

[22] Filed: Apr. 23, 1976

[21] Appl. No.: 679,562

[52] U.S. Cl. ..... 52/90; 52/265; 52/309.14; 52/584; 52/629; 428/81; 428/116

[51] Int. Cl.[2] ..... E04B 7/02

[58] Field of Search ..... 52/90, 264, 265, 309, 52/584, 629; 428/81, 83, 99, 116

[56] References Cited

UNITED STATES PATENTS

| | | | |
|---|---|---|---|
| 2,744,042 | 5/1956 | Pace | 52/309 X |
| 2,849,758 | 9/1958 | Plumley et al. | 52/309 |
| 2,915,791 | 2/1959 | Hauf | 52/264 X |
| 2,962,323 | 11/1960 | McBride | 52/265 X |
| 3,481,642 | 12/1969 | Bonallack et al. | 52/309 X |
| 3,621,624 | 11/1971 | Gustafson | 52/90 |
| 3,641,720 | 2/1972 | Berrie | 52/220 X |
| 3,736,715 | 6/1973 | Krumwiede | 52/404 X |
| 3,760,548 | 9/1973 | Sauer et al. | 52/404 X |
| 3,898,779 | 8/1975 | Tracy | 52/264 |

FOREIGN PATENTS OR APPLICATIONS

| | | | |
|---|---|---|---|
| 1,509,131 | 3/1969 | Germany | 52/90 |

*Primary Examiner*—Alfred C. Perham
*Attorney, Agent, or Firm*—John Holtrichter, Jr.

[57] ABSTRACT

Modular panels may be used as floor, exterior wall, interior wall and roof panels each including a honeycomb member sandwiched between skins to one of which a rectangular frame and insulation are affixed in a manner such that panels may be secured together in the same plane or in planes normal to each other using fasteners carried by the frames.

10 Claims, 13 Drawing Figures

BUILDING STRUCTURAL SYSTEM

BACKGROUND OF THE INVENTION

The background of the invention will be set forth in two parts.

1. Field of the Invention

The present invention pertains generally to the field of building structural systems and more particularly to new and useful modular panels which may be used as floor, interior wall, exterior wall and roof panels.

2. Description of the Prior Art

The prior art known to applicant is listed by way of illustration, but not of limitation, in separate communications to the United States Patent Office. The present invention exemplifies improvements over this prior art.

SUMMARY OF THE INVENTION

A primary object of the present invention is to provide a new and useful building panel.

Another object of the present invention is to provide a modular building panel including a honeycomb member sandwiched between skins to one of which a rectangular frame and insulation are affixed in a manner such that panels may be secured together in the same plane or in planes normal to each other.

According to the present invention, a building structural system is provided. The system comprises modular panels including a pair of suitable skins having inner surfaces to which a honeycomb core is bonded.

A frame and insulation are bonded to the outer surface of one of the skins. The frame may carry fasteners for connecting panels together in the same plane or in planes normal to each other.

The skins may be made of a suitable metal, such as steel, or aluminum, the frames are preferably hollow, tubular members of steel with a square cross sections; the honeycomb core may be paper and the insulation may be polyurethane foam.

The insulation may be covered with a sheet of decorative material when the panels are used as interior walls. Suitable flooring material may be used to cover the insulation on floor panels. Roof panels may have insulation provided on both their upper and lower surfaces with roofing material covering the insulation on the upper surface and ceiling material covering the insulation on the lower surface.

The fasteners may comprise nuts affixed to one leg of a frame for engagement by a bolt passing through an aperture provided in another leg of the frame on an adjacent panel.

The features of the present invention which are believed to be novel are set forth with particularity in the appended claims. The present invention, both as to its organization and manner of use, together with further objects and advantages thereof, may best be understood by making reference to the following description, taken in connection with the accompanying drawings.

BRIEF DESCRIPTION OF THE DRAWINGS

FIG. 9 is a cross-sectional view of a corner joint of two exterior walls which may be used in the system of FIG. 1;

FIG. 10 is a cross-sectional view of a joint of an interior to an exterior wall which may be used in the system of FIG. 1;

DESCRIPTION OF THE PREFERRED EMBODIMENT

Figure 1:
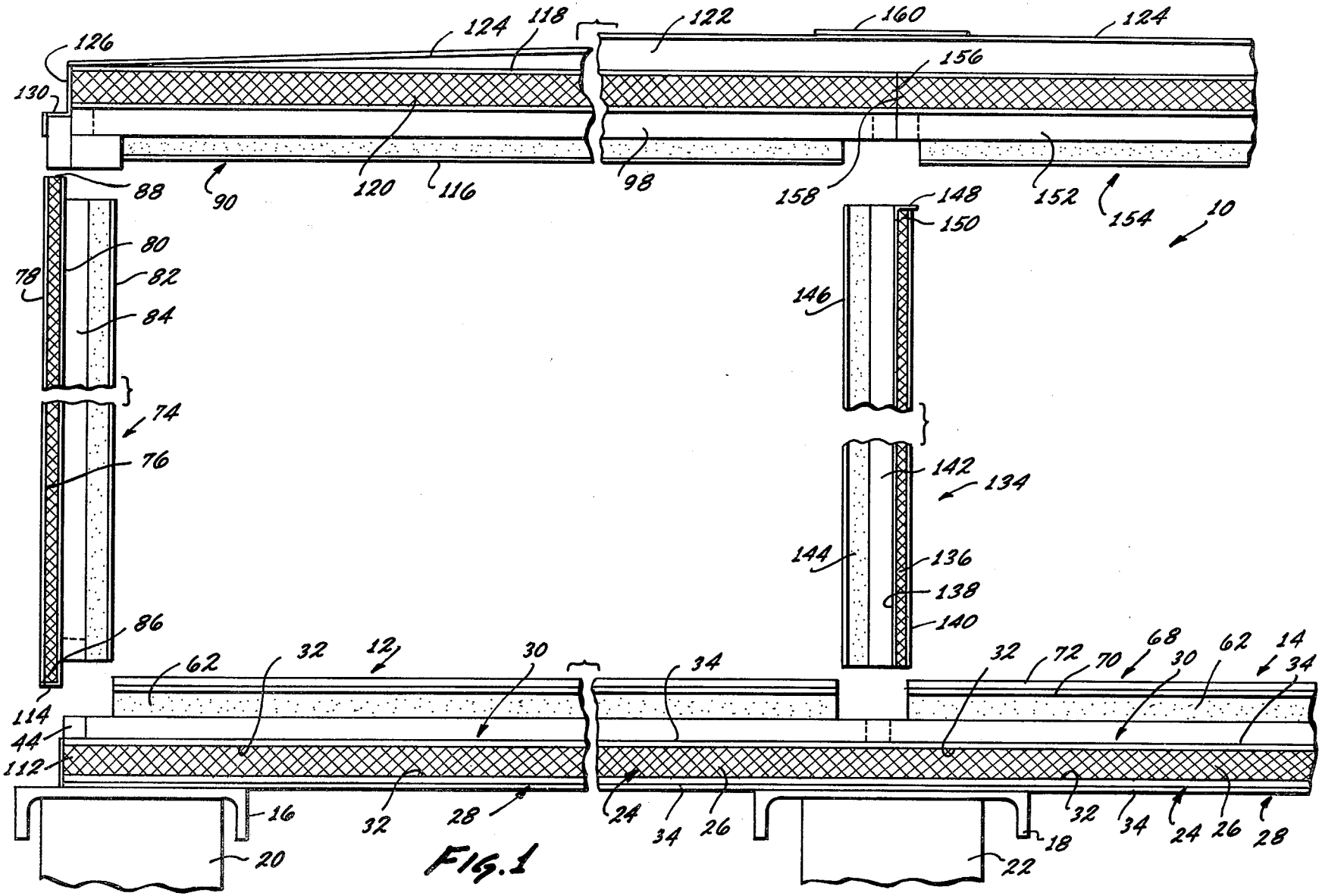
FIG. 1 is a cross-sectional view of a building structural system constituting a presently preferred embodiment of the invention.

Referring again to the drawings, and more particularly to FIGS. 1-5, a building structural system constituting a presently-preferred embodiment of the invention, generally designated 10, includes a plurality of floor panels, like the two shown at 12, 14 carried by steel channels 16, 18 resting upon cement piers 20, 22, respectively.

The floor panels 12, 14 each includes a laminated panel 24 having a two inch paper honeycomb core 26 sandwiched between a pair of metal skins 28, 30 each having an inner surface 32 and an outer surface 34. The skins 28, 30 may be made from 0.04 inch aluminum sheets, or the like and may have their inner surfaces 32 bonded to core 26.

Figure 2:
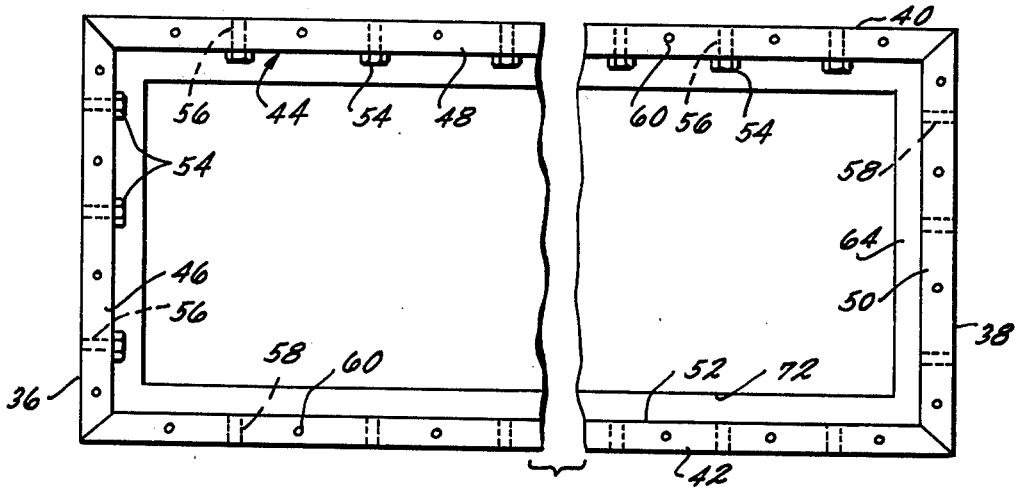
FIG. 2 is an enlarged plan view of a typical panel which may be used in the system of FIG. 1.

As best shown in FIG. 2 for the floor panel 12, each laminated panel 24 may be of rectangular extent extending longitudinally between opposite ends 36, 38 and transversely between opposite sides 40, 42. A rectangular frame 44 may be secured to the outer surface 34 of the upper skin 30. Frame 44 may be of 1½ inch square tubular construction from steel or the like and includes a plurality of members 46, 48, 50 and 52 lying adjacent end 36, side 40, end 38 and side 42, respectively. Frame members 46 and 48 may be provided with a plurality of suitable fasteners, like the nuts 54, which communicate with bolt holes 56 in alignment with bolt holes 58 provided in the frame members 50 and 52, respectively. Frame members 46, 48, 50 and 52 may also be provided with bolt holes 60 normal to the bolt holes 56 and 58.

The floor panels 12, 14 each includes a layer of insulation 62 having a first ply 64 (FIGS. 3 and 5) filling the cavity formed by the inner perimeter of rectangular frame 44 and the upper or outer surface 34 of an associated one of the skins 28, 30 and a second ply 66 which may be equal in thickness to the ply 64, which may be placed on top of the ply 64 and which has its outer perimeter spaced inwardly from the inner perimeter of frame 44 a predetermined distance which will be hereinafter manifested. The first ply 64 may consist of a sheet of polyurethane foam adhered to the applicable skin 28, 30 and the second ply 66 may consist of a sheet of polyurethane foam adhered to the first ply. Alternatively, suitable forms may be used to pour both plys as an integral unit.

The floor panels 12, 14 each also includes a suitable floor covering 68 comprising a sheet of plywood 70 adhered to the upper ply 66 of insulation 62 and floor tile 72 adhered to the plywood sheet 70. Sheet 70 may be ½ inch thick. Panels 12, 14 may be secured to channels 16, 18 by suitable bolts (not shown) passing through bolt holes 60.

Figure 3:
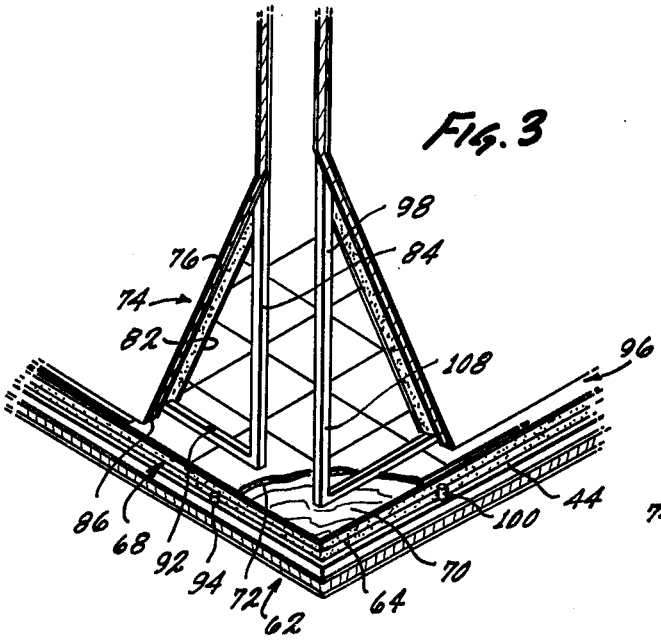
FIG. 3 is an enlarged, partial perspective view, with parts broken away to show internal construction, of a typical floor and corner section of the system shown in FIG. 1.

Building structural system 10 also includes a plurality of exterior wall panels, like the one shown at 74. These panels may be identical to the floor panels 12, 14 except that the honeycomb core 76 may be ¾ inch thick; he aluminum sheets 78, 80 may be 0.02 inch thick; the plywood sheet 82 may be 3/16 inch thick; the floor tile is dispensed with and the frame 84 is set back sufficiently from the lower end 86 and the upper end 88 of panel 74 to form suitable joints with floor panel 12 and a roof panel 90, respectively. The lower end 86 of panel 74 may be secured to floor panel 12 and channel 16 by suitable bolts (not shown) passing through channel 16 bolt holes 60 and into threaded engagement with suitable nuts, like the one shown at 92 in FIG. 3 provided on rame 84. Frame 84 may be properly located on floor frame 44 by suitable guide pins, like the one shown at 94 in FIG. 3.

Figure 4:
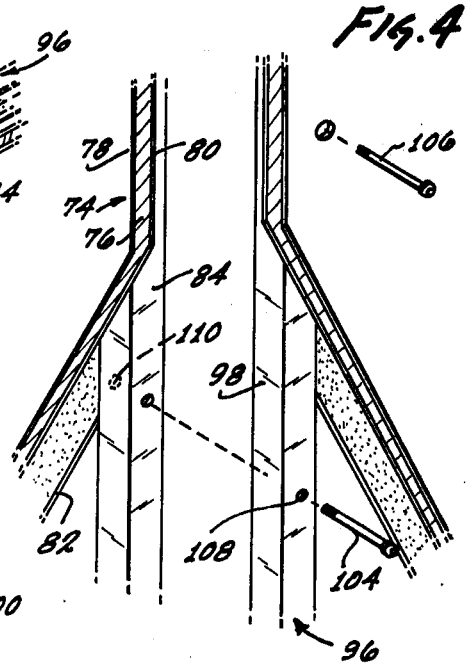
FIG. 4 is an enlarged, exploded perspective view of the area within circle four of FIG. 3.
Figure 5:
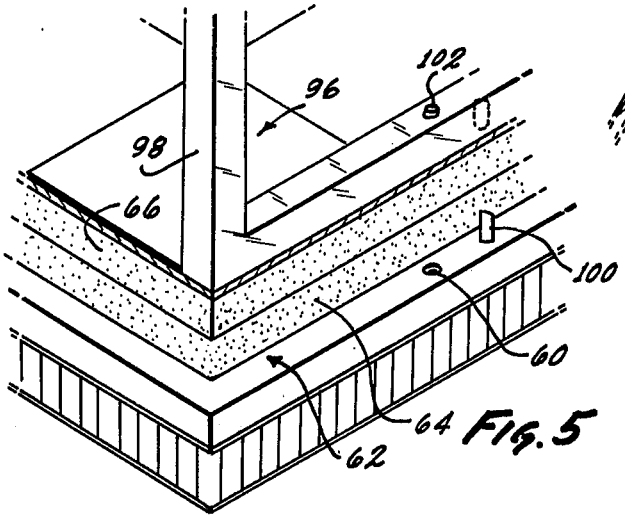
FIG. 5 is an enlarged, exploded perspective view of a portion of the floor and corner section shown in FIG. 3.

Referring now to FIGS. 3, 4 and 5, building structural system also includes a second exterior wall panel 96 which may be identical to the exterior wall panel 74 and which forms a corner with wall panel 74. Panel 96 includes a frame 98 engageable with a guide pin 100 on floor frame 44 to properly locate panel 96 with respect to panel 74. Frame 98 may be secured to floor frame 44 by suitable bolts (not shown) passing through bolt holes 60 in frame 44 and threadedly engaging suitable nuts on frame 98, like the one shown at 102 in FIG. 5. Frame 98 may be connected to frame 84 by a plurality of bolts, like the two shown at 104, 106 in FIG. 4, which pass through suitable bolt holes in frame 98, like the one shown at 108 in FIG. 4, and threadedly engage suitable nuts on frame 84, like the one shown at 110 in FIG. 4.

Referring again to FIG. 1, the exposed edges of floor panels 12, 14 may be covered with flashing 112 and the lower end 86 of panels 74 may be covered with flashing 114.

Roof panel 90 may be identical to floor panels 12, 14 except that floor tile is dispensed with and the plywood sheet 116 may be 3/16 inch thick. Additionally, the upper surface 118 of its core 120 may be covered with polyurethane insulation 122 which may be tapered as shown in FIG. 1 to provide a suitable slope. Insulation 122 may be covered with a 0.02 inch thick sheet 124 which may be made from aluminum or the like and which extends down over the exposed edge 126 of core 120 and the upper end 88 of panel 74 as shown at 128 and 130, respectively. Roof panel 90 includes a frame 132 which may be connected to frame 84 on panel 74 by suitable bolts and nuts (not shown).

The building structural system 10 also includes a plurality of interior wall panels, like the one shown at 134 in FIG. 1. Panel 134 may include a ¾ inch paper honeycomb core 136 sandwiched between 0.02 inch aluminum sheets 138, 140; a 1½ inch square tubular frame 142 a suitable layer of polyurethane foam insulation 144, which may be 1½ inches thicker than frame 142, and a 3/16 inch plywood sheet 146. Additionally, a 1½ inch by 1½ inch angle iron 148 may be provided on the upper edge 150 of core 136 and may be welded to frame 142 for connection to a frame 152 provided on a second roof panel 154. The inner edges 156 and 158 of roof panels 90, 154, may be connected together by suitable bolts and nuts (not shown) engaging frame 98, 142. These edges may be connected to the upper edge 150 of panel 134 by suitable bolts and nuts (not shown) by connecting frame 98 to frame 142 and frame 152 to angle iron 148. The upper surface of the joint formed by edges 156, 158 may be covered by a suitable flashing 160 adhered to roof covering 124 by suitable weatherproofing material (not shown).

Figure 6:
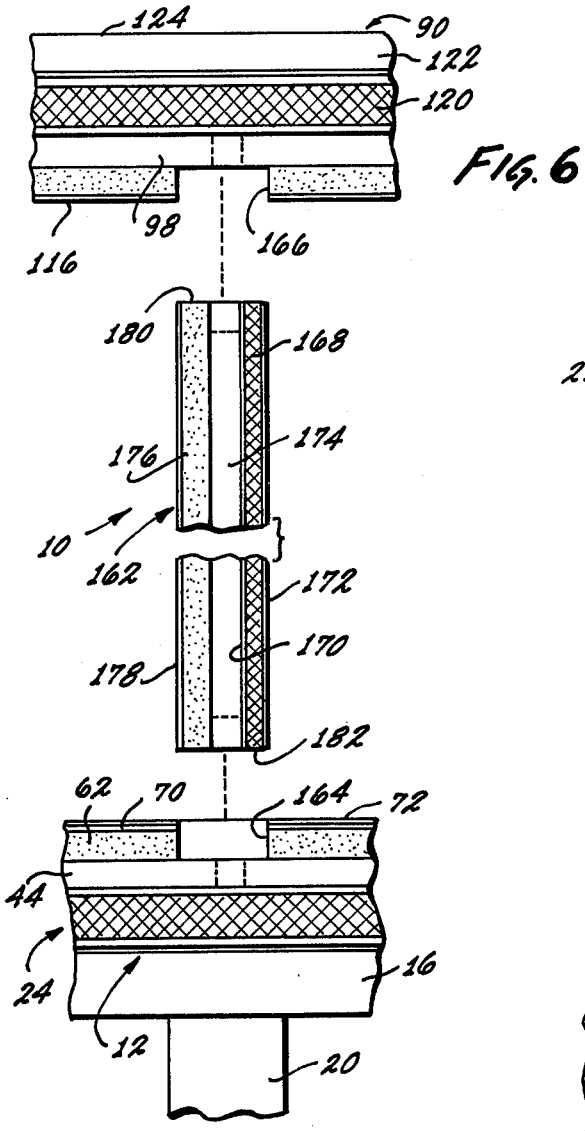
FIG. 6 is a cross-sectional view of a typical floor, roof and interior wall portion of the system shown in FIG. 1.

Referring now to FIG. 6, building structural system 10 may include an interior wall 162 adapted to be mounted at right angles to the wall panels 74, 134 in channels 164, 166 provided in floor panel 12 and roof panel 90, respectively. Wall 162 may comprise a ¾ inch paper honeycomb core 168 sandwiched between 0.02 inch aluminum sheets 170, 172; a frame 174 polyurethane foam insulation 176 and a 3/16 inch plywood sheet 178. Wall 162 includes an upper end 180 and a lower end 182 which may be fitted in channels 166, 164, respectively. Frames 174, 44, and 98 may be connected together by suitable bolts and nuts (not shown).

Figure 7:
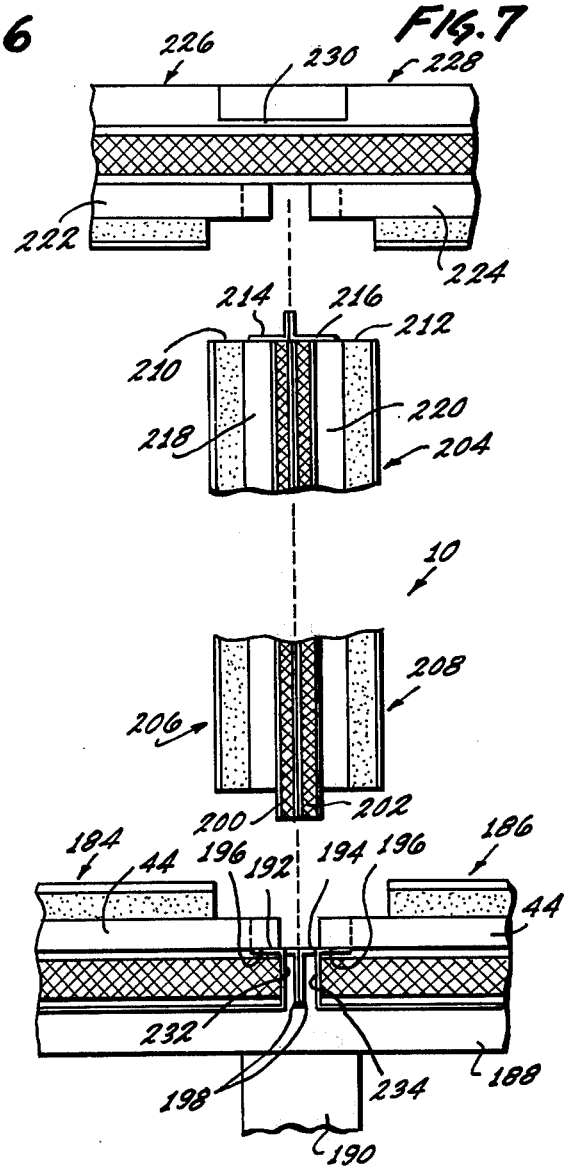
FIG. 7 is a cross-sectional view of a floor, roof and exterior wall joint using two modules which may be used in the building structural system shown in FIG. 1.
Figure 8:
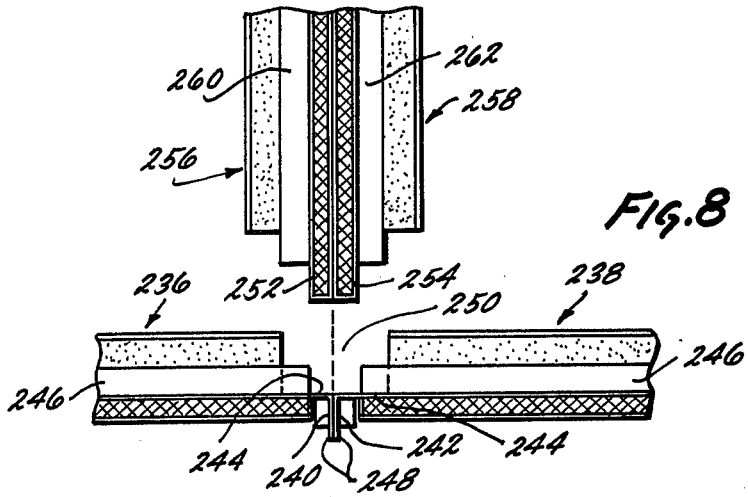
FIG. 8 is a cross-sectional view of two exterior wall joints with two modules which may be used in the system of FIG. 1.

Referring now to FIG. 7, building structural system 10 may also include a pair of floor panels 184, 186 supported by a channel 188 on suitable concrete piers, like the one shown at 190. Panels 184, 186 may be identical to the panels 12, 14 except that they are not connected together by their frames 44. Instead, they are connected together by a pair of metal angles 192, 194 each having legs 196, 198. The leg 196 on angle 192 may be welded to frame 44 on panel 184 and leg 196 on angle 94 may be welded to frame 44 on panel 186. Legs 198 on both angles may then be bolted together. Angles 192, 194 are dimensioned such that legs 196 will space channels 44 apart sufficiently that two ¾ inch paper honeycomb cores 200, 202 on a wall 204 comprising two wall panels 206, 208 which may be placed back to back and joined together at their upper edges 210, 212, respectively by a pair of metal angles 214, 216 welded to frames 218, 220, respectively, and bolted together. Angles 214, 216 may be received between frames 222, 224 on roof panels 226, 228, respectively. It will be understood by those skilled in the art that the floor panels, wall panels, and roof panels will have the same basic construction as their counterparts previously described. It will also be understood that roof panels 226, 228 will be provided with flashing 230 and that floor panels 184, 186 will be provided with flashing 232, 234, respectively FIG. 8 shows how a joint may be formed by connecting two exterior wall panels together in end-to-end relationship with two more panels connected together in back-to-back relationship normal to the other two panels. Two exterior wall panels 236, 238, which may have the same basic construction as the exterior wall panels previously described, may be connected together in end-to-end relationship by metal angles 240, 242 each having a first leg 244 welded to an associated one of the channels 246 on panels 236, 238 and a second leg 248 secured to a like leg on the other angle by suitable bolts (not sown). This forms a cavity 250 for receiving the ends 252, 254 of exterior panels 256, 258, respectively, having the same basic construction as the exterior panels previously described. Panel 256 may then be connected to panel 236 by connecting frame 246 on panel 236 to frame 260 on panel 256 and panel 238 may be connected to panel 258 by connecting frame 246 on panel 238 to frame 262 on panel 258.

FIG. 9 shows how two exterior wall panels 264, 266 may be connected together to form a corner joint 268. This may be accomplished by having one edge 270 of panel 264 engage the inner surface 272 of the laminated panel 274 adjacent the end 276 of frame 278 on panel 266. Frame 278 on panel 266 may then be connected to frame 280 on panel 264 by passing bolts through frame 278 and engaging them in nuts (not shown) carried by frame 280. Panels 264, 266 may have the same basic construction as the exterior panels previously described.

Referring now to FIG. 10, an interior wall panel 282 may be connected to an exterior wall panel 284 by engaging the flush end 286 of panel 282 in a channel 288 provided in panel 284. Suitable bolts (not shown) may then be passed through frame 290 on panel 284 and engaged in suitable nuts (not shown) provided on frame 292 in panel 282. Here again, the panels 282, 284 may have the same basic construction as the interior and exterior panels previously described.

Figure 11:
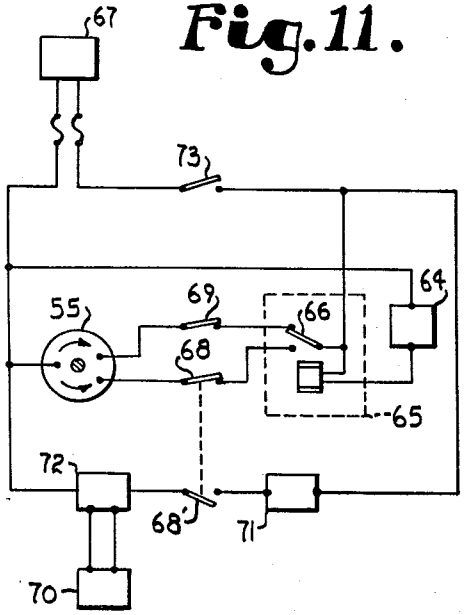
FIG. 11 is a cross-sectional view of a joint of two corridor roof panels of the system of FIG. 1.

FIG. 11 shows a typical construction for two corridor roof panels 294, 296 each having a laminated panel 298 consisting of a 2 inch paper honeycomb core 300 sandwiched between 0.04 inch aluminum sheets 302, 304. Sheet 302 includes a lower surface 306 to which a frame 308 and a layer of polyurethane foam 310 are affixed. Frame 308 may be made from 1½ inch square tubes and the polyurethane foam may extend 1½ inches above frame 308. A 3/16 inch plywood sheet 312 may be adhered to the polyruethane foam for forming the ceiling of building structural system 10. A two inch polyurethane foam sheet 314 may be affixed to the upper surface 316 of the aluminum sheet 314 for additional insulation and this insulation may be covered with a 0.02 inch aluminum sheet 318. The edges 320, 322 of panels 296, 294, respectively, may be joined together by passing bolts, like the one shown at 324, through frame 308 on panel 296 into threaded engagement with nuts, like the one shown at 326, carried by frame 308 on panel 294. The joint formed by edges 320, 322 may be covered with a suitable flashing 328.

Figure 12:
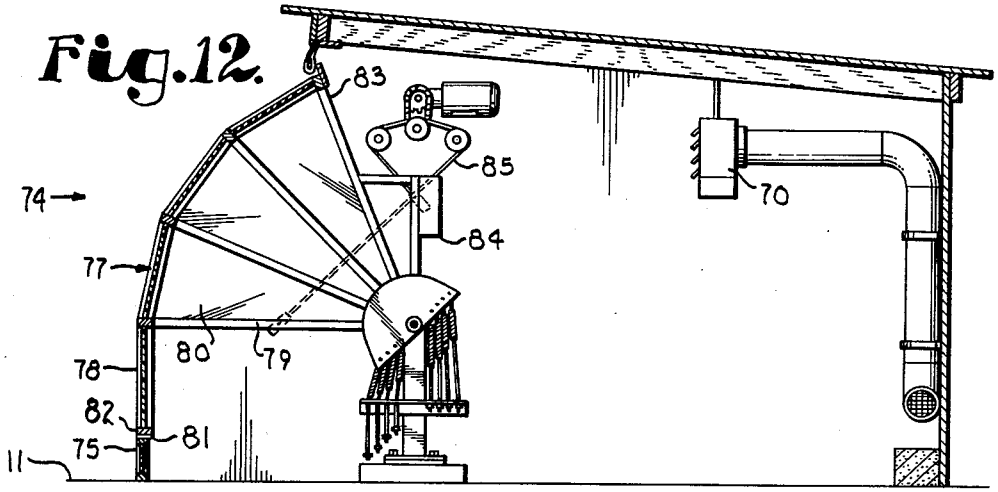
FIG. 12 is a cross-sectional view of a joint of two corridor floor panels of the system of FIG. 1.

FIG. 12 shows two typical corridor floor panels 330, 332 each having a laminated panel 334 consisting of a 1½ inch paper honeycomb core 336 laminated between a pair of 0.04 inch aluminum sheets 338, 340; a frame 342; a polyurethane foam sheet 344 and a suitable floor covering 346. Panels 330, 332 may be connected together by a pair of metal angles 346, 348. Angle 346 has a leg 350 affixed to the frame 342 on panel 330 and the angle 348 has a leg 352 affixed to frame 342 on panel 332. Additionally, angle 346 has a leg 354 affixed to a leg 356 on angle 348. The edge 358 of panel 330 may be covered with a flashing member 360 and the edge 362 of panel 332 may be covered with a flashing member 364.

Figure 13:
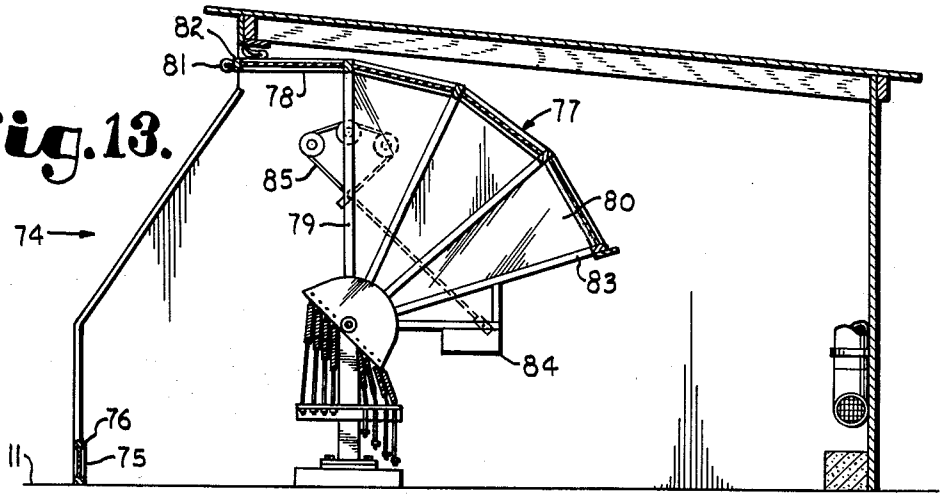
FIG. 13 is a cross-sectional view of a typical nut and bolt assembly which may be used in the system of FIG. 1.

Referring now to FIG. 13, a typical nut and bolt assembly 366 which may be used in the construction of building structural system 10 includes a blind nut assembly 368 and a bolt 370. The blind nut assembly 368 includes an expander 372 which may be threadedly engaged by bolt 370 to expand a sleeve 374.

From the foregoing, it should be evident that there has herein been described a new and useful building structural system comprising well-insulated panels from which buildings may be constructed speedily, efficiently and economically.

Although exemplary embodiments of the invention have been shown and described, changes and modifications and other embodiments of the invention may be made by one having ordinary skills in the art without necessarily departing from the spirit and scope of the invention.

What is claimed is:

1. A building panel construction comprising:

a laminated member including a pair of skins each having an outer surface and an inner surface, and a core of honeycomb material bonded to said inner surfaces of said skins, said laminated member having a pair of sides and a pair of ends;

a rectangular frame affixed to said laminated member along a perimeter defined by said sides and said ends; and fasteners affixed to said frame for connecting the frames of abutting panels together.

2. A building panel construction as stated in claim 1 including insulating material affixed to said laminated member inside said frame.

3. A building panel construction as stated in claim 1 wherein said frame includes four square tubular members and wherein said fasteners comprise nuts affixed to some of said frame members and bolt holes provided in the remaining frame members.

4. A building panel construction as stated in claim 1 wherein said skins are made of metal.

5. A building panel construction as stated in claim 2 wherein said insulating material is polyurethane foam.

6. A building panel construction as stated in claim 2 including a plywood skin, bonded to said insulating material.

7. A building structural system including modular floor, exterior wall, interior wall and roof panels, each of said panels being characterized by:

a laminated member including a pair of skins each having an outer surface and an inner surface, and a honeycomb core bonded to said inner surfaces of said skins, said laminated member having a pair of sides and a pair or ends;

a frame including four frame members bonded to said laminated member along a perimeter defined by said sides and said ends;

fasteners provided on said frame members for connecting abutting frames of adjacent panels together; and polyurethane foam insulation affixed to said laminated member and filling the space circumscribed by said frame, said insulation having a thickness twice that of said frame.

8. A building structural system as stated in claim 7 further characterized by a sheet of interior finishing material affixed to said insulation.

9. A building structural system as stated in claim 7 further characterized by:

a second layer of insulating material affixed to said laminated member on its surface which is opposite to the surface carrying said frame and a metal skin covering said second layer of insulating material.

10. A building structural system comprising:

A. a horizontal floor having plurality of panels, each of said floor panels comprising:

1. a first sandwich panel having a first lower metal sheet, a first intermediate honeycomb member and a first upper metal sheet;
2. a first rectangular, hollow metal frame secured to said first upper metal sheet;
3. a first polyurethane foam sheet secured to the area of said first upper metal sheet which lies inside said first hollow metal frame, said first polyurethane foam sheet having an upper surface lying above said first hollow metal frame;
4. a first wooden sheet secured to the upper surface of said first polyurethane foam sheet; and
5. first fasteners connecting said first hollow frames of adjacent four panels together in a horizontal plane;

B. a vertical exterior wall having a plurality of panels, each of said exterior wall panels comprising:

1. a second sandwich panel having an outer metal sheet, a second intermediate honeycomb member and an inner metal sheet;
2. a second rectangular, hollow metal frame secured to said inner metal sheet;
3. a second polyurethane foam sheet secured to the area of said inner metal sheet which lies inside said second hollow metal frame, said second polyurethane foam sheet being thicker than said second hollow metal frame so that the inner surface of said second polyurethane foam sheet lies beyond said second hollow metal frame toward the inside of said building;
4. a second wooded sheet secured to said inner surface of said second polyurethane sheet;
5. second fasteners connecting said second hollow metal frames of adjacent exterior wall panels together in a vertical plane; and
6. third fasteners connecting said first and said second hollow metal frames of adjacent floor and exterior wall panels together in a horizontal plane; and C. a roof having a plurality of panels, each of said roof panels comprising:

1. a third wooden sheet lying in a horizontal plane inside said building, said third wooden sheet having a lower surface and an upper surface;
2. a third polyurethane foam sheet secured to the upper surface of said third wooden sheet, said third polyurethane foam sheet having an upper surface and a lower surface;
3. a second lower metal sheet secured to the upper surface of said third polyurethane foam sheet, said second lower metal sheet having a lower surface and an upper surface;
4. a third hollow metal frame secured to the lower surface of said second lower hollow metal sheet in encompassing relationship with said third polyurethane foam sheet;
5. a third honeycomb member having an upper surface and a lower surface, said lower surface of said third honeycomb member being secured to the upper surface of said second lower metal sheet;
6. a second upper metal sheet having a lower surface and an upper surface, said lower surface of said second upper metal sheet being secured to said upper surface of said third honeycomb members;
7. a fourth polyurethane foam sheet having an upper surface and a lower surface, the lower surface of said fourth polyurethane foam sheet being secured to said upper surface of said second upper metal sheet;
8. fourth fasteners connecting said third hollow metal frame to said second hollow metal frame in a horizontal plane; and
9. a metal roof skin covering said upper surface of said fourth polyurethane foam sheet.

* * * * *